US006054909A

United States Patent [19]

Lee et al.

[11] Patent Number: 6,054,909

[45] Date of Patent: Apr. 25, 2000

[54] MICROWAVE FILTER WITH U-TYPE RESONATOR

[75] Inventors: Chang Hwa Lee; Myung Soo Kim; Bon Hee Koo; Dong Suk Jun; Sang Seok Lee; Tae Goo Choy, all of Daejeon, Rep. of Korea

[73] Assignee: Electronics and Telecommunications Research Institute, Daejon, Rep. of Korea

[21] Appl. No.: 09/137,711

[22] Filed: Aug. 21, 1998

[30] Foreign Application Priority Data

Oct. 7, 1997 [KR] Rep. of Korea ..... 97-51436

[51] Int. Cl.[7] ..... H01P 1/205; H01P 7/04

[52] U.S. Cl. ..... 333/206; 333/222

[58] Field of Search ..... 333/202, 206, 333/207, 222

[56] References Cited

U.S. PATENT DOCUMENTS

| | | | |
|---|---|---|---|
| 4,431,977 | 2/1984 | Sokola et al. | 333/202 X |
| 4,733,208 | 3/1988 | Ishikawa et al. | 333/202 |
| 5,208,565 | 5/1993 | Sogo et al. | 333/206 |
| 5,602,518 | 2/1997 | Clifford, Jr. et al. | 333/206 X |

FOREIGN PATENT DOCUMENTS

| | | | |
|---|---|---|---|
| 62-213301 | 9/1987 | Japan | 333/202 |
| 4-302503 | 10/1992 | Japan | 333/202 |
| 6-6109 | 1/1999 | Japan | 333/202 |

OTHER PUBLICATIONS

Miniaturized Antenna Duplexers for Portable Radio Telephone Terminals; Morikazu Sagawa, Mitsuo Makimoto, Kazuhiro Eguchi and Fumio Fukushima; 1990; pp. 417–420.

A Stepped Impedance Comb–Line Filter Fabricated By Using Ceramic Lamination Technique; Toshio Ishizaki and Tomoki Uwano; 1994; pp. 617–620.

A Miniaturized Dielectric Monoblockband–Pass Filter For 800MHz Band Cordless Telephone System; Haruo Matsumoto, Hiromi Ogura and Toshio Nishikawa; 1994; pp. 249–252.

*Primary Examiner*—Seungsook Ham

*Attorney, Agent, or Firm*—Antonelli, Terry, Stout & Kraus, LLP

[57] ABSTRACT

The present invention relates to a microwave filter, having U-type resonators, which passes a desired frequency signal and removes an undesired frequency signal when used in a high frequency antenna circuit for wireless communication systems. In accordance with the trend of reducing communication system terminals, it is required to reduce a high frequency filter. The high frequency filter is required to attenuate signals very sharply at the stop band especially near to a passband transmitting and receiving frequency, so as to improve the efficiency of the frequency. The filter may be reduced in weight by forming U-type resonators instead of straight-type resonators. Excellent attenuation characteristics may be achieved at the stop band lower than the passband, using the difference of the characteristic impedance between the open end portion and the shorted portion of the resonator by forming the coupling control grooves at the outer walls of the dielectric block.

5 Claims, 4 Drawing Sheets

MICROWAVE FILTER WITH U-TYPE RESONATOR

BACKGROUND OF THE INVENTION

1. Field of the Invention

The present invention relates to a microwave filter using a dielectric block and, more particularly, to a microwave filter, having U-type resonators which passes a desired frequency signal and removes an undesired frequency signal upon being used in a high frequency antenna circuit of radio communication systems such as a mobile communication, a personal communication, a satellite communication, and IMT-2000.

2. Description of the Prior Art

Recently, in a high frequency filter used in the antenna terminal in radio communication systems, dielectric block coaxial resonators of TEM mode have been widely used. The number of coaxial resonators used is determined depending on the required characteristics of a filter, generally, the filter is fabricated by means of two or more resonators.

A conventional high frequency filter structure using a dielectric block is shown in FIGS. 6 and 7, wherein the conventional high frequency filter is an integrated structure upon forming two or more resonators to a dielectric block, it is a filter structure using three resonators therein. In FIGS. 6 and 7, the dielectric block 1 is a structure in which all portions are coated with a conductive metal except a top surface 1*a* and coupling quantity control holes 3 which controls the coupling quantity between resonators.

The dielectric block 1 includes apertures corresponding to the resonators 2 and the apertures extending from one surface, that is, a top surface, to an opposite (bottom) surface, are arranged in a line in parallel with each other. All the surfaces of the dielectric block 1, except the top surface thereof, and inner surfaces of the coupling quantity control holes 3 are coated with a conductive film. Then, the bottom surface of the dielectric block 1 acts as a shorted portion connected to a ground voltage level and the aperture acts as resonator of the ¼ wavelength. Also, conductive rods 5 for input and output terminals are inserted into the apertures of the first and last resonators, respectively, and dielectric materials 4 are inserted between the conductive rods and resonators for coupling between input and output terminals and resonators. Further, for properly controlling the coupling quantities, there is structured a filter whose holes 3 for controlling coupling quantities are formed between resonators respectively. The input signal through input apertures is transferred to the resonators by means of an electric field couple between the inner surface of the apertures for the input terminal arid the resonator, the signal is transferred from a front resonator to a back resonator with the electromagnetic field coupling between the resonators. Further, since the signal is transferred to the output apertures by means of the electric field coupling between the resonator and apertures for the output terminals, the energy is transferred to the output through the resonators from the input. At this time, in order to control the coupling quantity of the electric field between the resonators, there are formed holes 3 for controlling the coupling quantity. Since this coupling structure regards an inner of the hole 3 for controlling the coupling quantity as a space, it decreases the coupling quantity due to the difference of the dielectric susceptivity of the dielectric block. Accordingly, it is possible to miniaturize the filter, and the coupling quantity between the resonators can be regulated by changing the size of the hole for controlling the coupling quantity. Furthermore, the middle portion of the dielectric block 1 is strong in the electric field, the portion near to the front and back surface of the dielectric block is gradually weak in the electric field. Accordingly, since the hole position for controlling the coupling quantity is moved from the middle direction to the front or rear surface direction of the dielectric block, the coupling quantity is regulated. However, it is difficult to accomplish a miniaturization since the control of the coupling quantity by means of the position movement or the size of a hole for controlling the coupling quantity has a limit according to the miniaturization of parts. Moreover, the inner surface of the resonators is coated with a conductive metal and the inner surface of the hole 3 for controlling the coupling quantity is not coated with a conductive metal. Therefore, when the inner surface of the resonators is coated with a conductive metal after fabricating the dielectric block 1, it is problematic that the fabrication process is complex since the following process is required in order that the inner surface of the hole for controlling the coupling quantity is not coated with a conductive metal, the undesired signal is transferred through the opened surface of the dielectric block by means of the transferred signal to the input side. In view of the frequency characteristics of these wide band pass filters, the attenuation characteristics of the frequency higher than the pass wide band is equal to that of the frequency lower than it as FIG. 8. However, for an efficient usage of frequency in the radio communication system, since the transmitting and receiving frequency wide band are positioned near to each other, for the high frequency filter, there is required an excellent attenuation characteristics in the near band to the stop band.

To improve the attenuation characteristics in the stop band, if there are used a lot of numbers of resonators in the filter, the attenuation characteristics are improved but the insertion loss increases and the filter size increases. Accordingly, a filter having a pole, which improves the attenuation characteristics upon cutting off signals at a specified frequency with a chip capacitor or inductor in the external without increasing the number of resonator, has been designed. However, there is a problem that the fabrication process is complex because of using the external chip device.

In the filter structure of FIG. 7, as another conventional art, in order to control a coupling quantity between the resonators, grooves 6 are formed for controlling the coupling quantity from the front and rear surface of a dielectric block 1 to the top and bottom surface of the dielectric block, coated with the conductive metal. Such a structure can simplify a fabrication process because of decreasing the following process so that the inner surface of the coupler may not be the conductive metal. However, since the middle portion of the dielectric block is strong in the electric field and the front or rear surface of the dielectric is weak in the electric field, the control of the coupling quantity using the grooves for controlling this coupling quantity is very weak, there is a limit for the miniaturization of parts. That is, there has been still a problem which improves the attenuation characteristics in the stop band.

SUMMARY OF THE INVENTION

It is an object of the present invention to provide a microwave filter having excellent attenuation characteristics at the stop band without using external elements, such as a chip capacitor and a chip inductor, whose a miniaturization is possible when fabricating a filter used in a high frequency circuit of communication systems by using the dielectric.

It is another object of the present invention to provide a microwave filter capable of being manufactured by simply processes to reduce its cost.

In accordance with an aspect of the present invention, a microwave filter with U-type resonator comprises: a U-type resonator, which is connected with the conductive tube other side end of the shorted end the insulator is not formed, includes a conductive film for the ground formed by coating an electrical conductive material to the entire surface except for the bottom surface of the dielectric block; two cylinder penetrating holes which penetrate from a top surface to a bottom surface of a dielectric block, a half-circular coupling groove so that said two holes can be interconnected to the bottom surface of the dielectric block, a U-type conductive tube coated with a conductive material in the inner surface of the penetrating holes and semi-circular coupling groove, an insulator for insulating the top surface of the dielectric block in order that one side end of the U-type conductive tube can be an open end; a plurality of resonators composed of said U-type conductive tubes formed in said dielectric block in parallel in a constant space; a coupling control groove for preventing signal coupling by means of an electric field between the resonators and between the conductive tubes of the open end side to which said insulator is formed so as to have attenuation characteristics at the stop band of frequency higher than a pass band; and an insulator formed on two surfaces of the right and left side edges of the direction to which the conductive tube end of the open end side is formed, said insulator of the dielectric block being formed on the open end side of the conductive tube, said plurality of resonators being formed to the dielectric block in parallel, input and output terminals which are insulated with the surface conductive film of the dielectric block by means of the insulator, electrically connected with the dielectric block.

In a preferred embodiment of forming the coupling control groove between the resonators, the attenuation characteristics are improved at the stop band higher than a pass band by controlling a signal coupling quantity by means of a magnetic field due to forming the grooves between the conductive tubes of the open end side of the U-type resonator, and at the stop band of frequency lower than a pass band by controlling a signal coupling quantity by means of an electric field due to forming the grooves between the conductive tubes of the shorted end side of the U-type resonator.

BRIEF DESCRIPTION OF THE DRAWINGS

The above and other objects and features of the present invention will become apparent from the following description of preferred embodiments, when taken in conjunction with the accompanying drawings, in which.

DETAILED DESCRIPTION OF THE PREFERRED EMBODIMENTS

Hereinafter, the embodiment of the present invention will be in detail explained with reference to the attached drawings.

Figure 1:
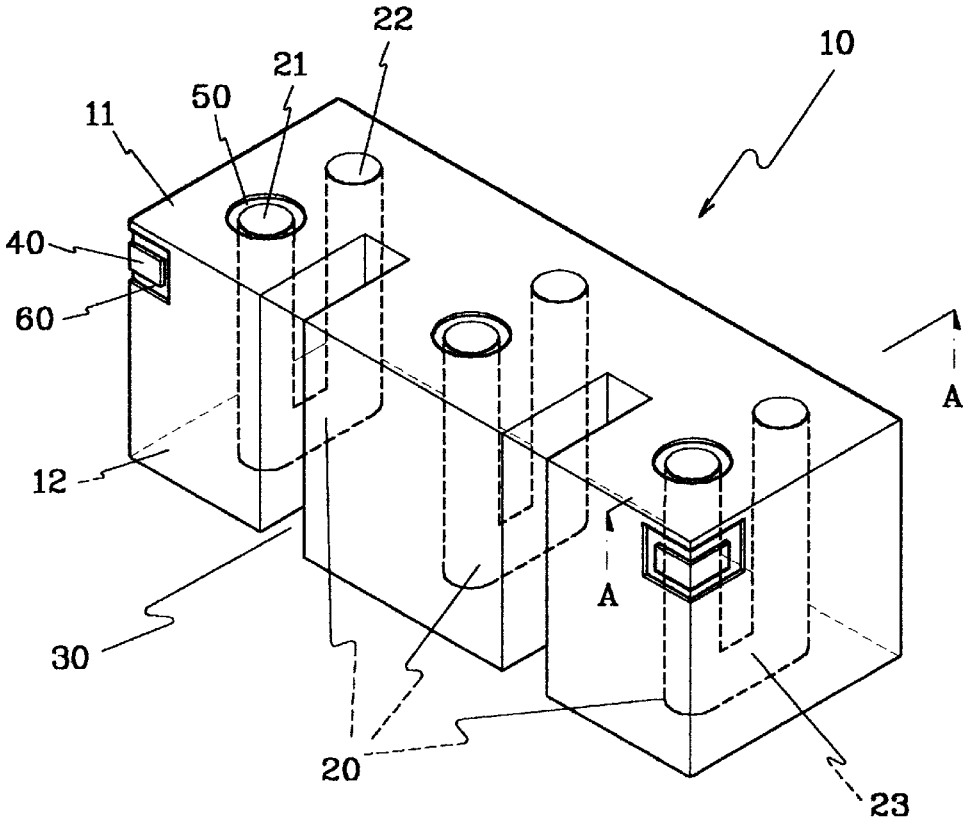
FIG. 1 is a filter construction view of one embodiment according to the present invention.

FIG. 1 is a filter construction view of one embodiment according to the present invention.

As shown in FIG. 1, one embodiment of the present invention comprises one U-type resonator 20, which is connected with the conductive tube other side end 22 of the shorted-end whose the insulator 50 is not formed, and forms a conductive film for the ground by coating an electrical conductive material to the surface except for the bottom surface 12 of the dielectric block; two cylinder penetrating holes 21, 22 which penetrate from a top surface 11 to a bottom surface 12 of the dielectric block 10, a half-circular coupling groove 23 so that the two holes 21, 22 can be interconnected to the bottom surface 12 of the dielectric block, a U type conductive tube 20 coated with a conductive material in the inner surface of the penetrating holes 21, 22 and semi-circular coupling groove 23, an insulator 50 for insulating one side end 21 of the U-type conductive tube with the top surface of the dielectric block, a plurality of resonators 20 composed of U-type conductive tubes being formed in parallel in a constant space to the dielectric block 10, a coupling control groove for preventing signal by means of the electric field between the resonators 20 and between the conductive tubes 21 of the open end side to which the insulator 50 is formed in order to have the attenuation characteristics at the stop band of frequency higher than a pass band, an insulator 60 formed on two surfaces of the right and left side edges of the direction to which the conductive tube end 21 of the opened end side is formed, the insulator 50 of the dielectric block to which the 3 resonators are formed in parallel being formed to the open end side of the conductive tube, and input and output terminals 40 which is insulated with the surface conductive film of the dielectric block by means of the insulator 60, electrically connected with the dielectric block 10.

Figure 2:
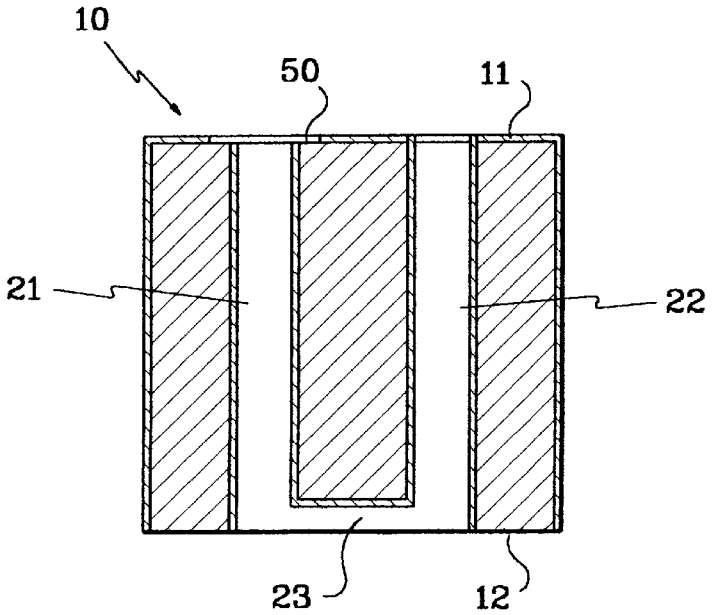
FIG. 2 is a sectional view taken on line A—A of U-type resonator in FIG. 1.

All portions of the dielectric block 10 are coated with the conductive metal except for the resonator short preventive insulator 50 and the input and output terminal earth preventive insulator 60 in order that the conductive tube 21 of the open end side of U type resonator can not be shorted to the earth. FIG. 2 is a sectional view taken on line A—A of U type resonator 20 in FIG. 1. It shows the conductive tube 21 of the open end side and the conductive tube 22 of the shorted end side of U-type resonator coated with the conductive material, which is formed upon penetrating the dielectric block from the top surface 11 to the bottom surface thereof, and a half-circular coupling groove 23 of U-type resonator formed to the dielectric block to electrically connect them. The conductive tube 21 of the open end side is electrically opened with the top surface of the dielectric block of the earth surface by means of the short preventive insulator 50 in the top surface of the dielectric block, other end thereof is electrically connected with the portion of the resonator groove 23 in the bottom surface of the dielectric block. One end of the conductive tube 22 of the shorted end side is electrically connected to a half-circular coupling groove 23 in the bottom surface of the dielectric block, other end is electrically opened with the earth surface in the top surface of the dielectric block. Accordingly, the conductive tube 21 of the open end side of the U-type resonator and the conductive tube 22 of shorted end side and the half-circular coupling groove 23 are electrically interconnected, one end thereof acts as ¼ wavelength resonators 21, 22, 23 shorted to the earth.

The input and output terminal 40 for inputting and outputting the signals is electrically cut off with the conductive film by means of the input and output terminal earth preventive insulator 60.

Accordingly, signals, which are received to the input and output terminals in the one embodiment structured as above, are transferred to a first resonator. These signals transferred to the first resonator, in this order, are transferred to the adjacent resonators by means of the electromagnetic coupling, which are transferred to a last resonator. Since the signals transferred to the last resonator are transferred to the output terminal 40 through the electric coupling, the dielectric block acts as a filter.

At this time, the coupling control grooves 30 between the resonators are formed from the top surface to the bottom surface of the dielectric block, and coated with the conductive metal, and then control the coupling therebetween.

The ¼ wavelength resonator whose one end is shorted has the highest electric field at its open side and has the highest magnetic field at its shorted side. Therefore, the conductive tube 21 of the open end side of U-type resonator has the highest electric field, and the conductive tube 22 of the short end side of U type resonator has the highest magnetic field. Accordingly, since the coupling control grooves 30 between the conductive tube 21 of the open end side of U-type resonator are formed, the coupling between the resonators is coupled by means of the magnetic field. Further, since the coupling control grooves are formed, the impedance of the conductive tube 21 of the open side of U-type resonator is different from the impedance of the conductive tube 22 of the shorted end side of U-type resonator. Thus, in the stepped impedance resonator having different impedance in the shorted side and open side, the coupling relationship between the resonators is expressed by odd even mode admittance, as follows:

$$\begin{bmatrix} -j\frac{1}{2}y_2\{B_0(f)+B_e(f)\} & -j\frac{1}{2}y_2\{B_0(f)-B_e(f)\} \\ -j\frac{1}{2}y_2\{B_0(f)-B_e(f)\} & -j\frac{1}{2}y_2\{B_0(f)+B_e(f)\} \end{bmatrix}.$$

Figure 5:
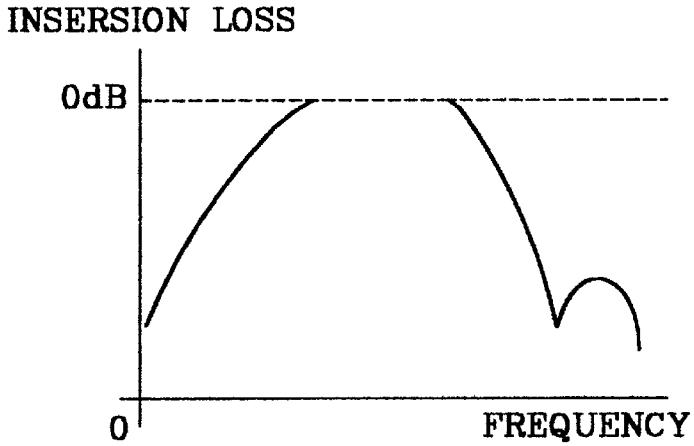
FIG. 5 is an insertion loss characteristic view according to the frequency in the embodiments of FIGS. 1 and 4.
Figure 6:
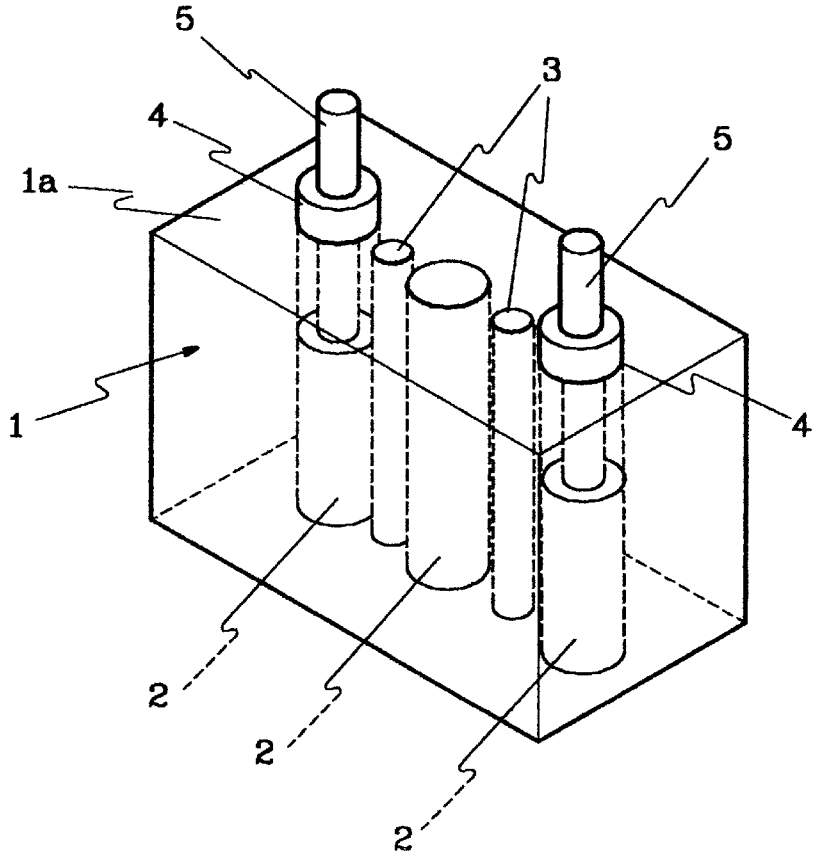
FIG. 6 PRIOR ART
FIG. 6 is a filter construction view according to the conventional dielectric material.
Figure 7:
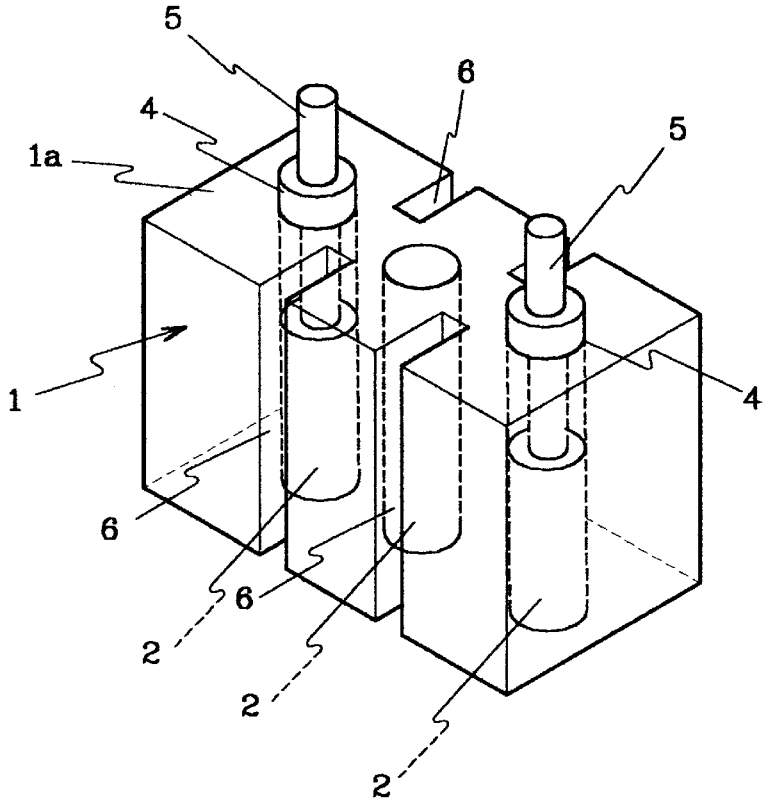
FIG. 7 PRIOR ART
FIG. 7 is another filter construction view according to the conventional dielectric material.
Figure 8:
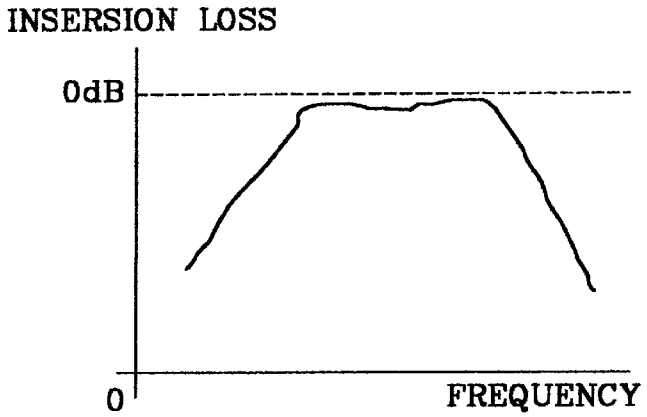
FIG. 8 PRIOR ART
FIG. 8 is an insertion loss characteristic view according to the frequency in the prior filter of FIGS. 6 and 7.

Wherein, $y_2$ is odd mode admittance of the conductive tube 21 of the open ended side of U-type resonator, $B_0(f)$ is a susceptance of a resonator expressed using odd mode admittance. $B_e(f)$ is a susceptance of a resonator expressed using even mode admittance. Accordingly, because the received signals are not transferred to the output terminal and flow into a ground level so that a pole in which the signal transmission is not made is generated at the frequency at which resonator's susceptance using the odd mode admittance is equal to the that using the even mode admittance. As shown in FIG. 1, if the coupling control groove is formed between the conductive tubes of the open end side, the coupling between resonators is coupled by means of the magnetic field, a pole frequency to which signals are not transferred can be positioned at the frequency higher than the pass band. Therefore, as shown in FIG. 5, the attenuation characteristics may be improved at the stop band higher than the pass band.

Further, the electric connection between the conductive tube 21 of the open end side of U-type resonator and the conductive tube 22 of the shorted end side of U-type resonator can be achieved by electrode patterns instead of a semi-circular coupling groove 23 of a resonator.

The filter structure of the present invention may be reduced in terms of weight, by forming U-typed resonators instead of straight-typed resonators. The surface package is possible by respectively forming input and output electrodes to the outer wall of the dielectric block through two surfaces. The excellent attenuation characteristics may be achieved at the stop band higher than the pass band, using the difference of the characteristic impedance between the open ended portion and the shorted portion of the resonator, by forming the coupling control grooves at the outer wall of the dielectric block. The filter of the present invention has effect on simplification of the processes and cuts down manufacturing cost.

Figure 3:
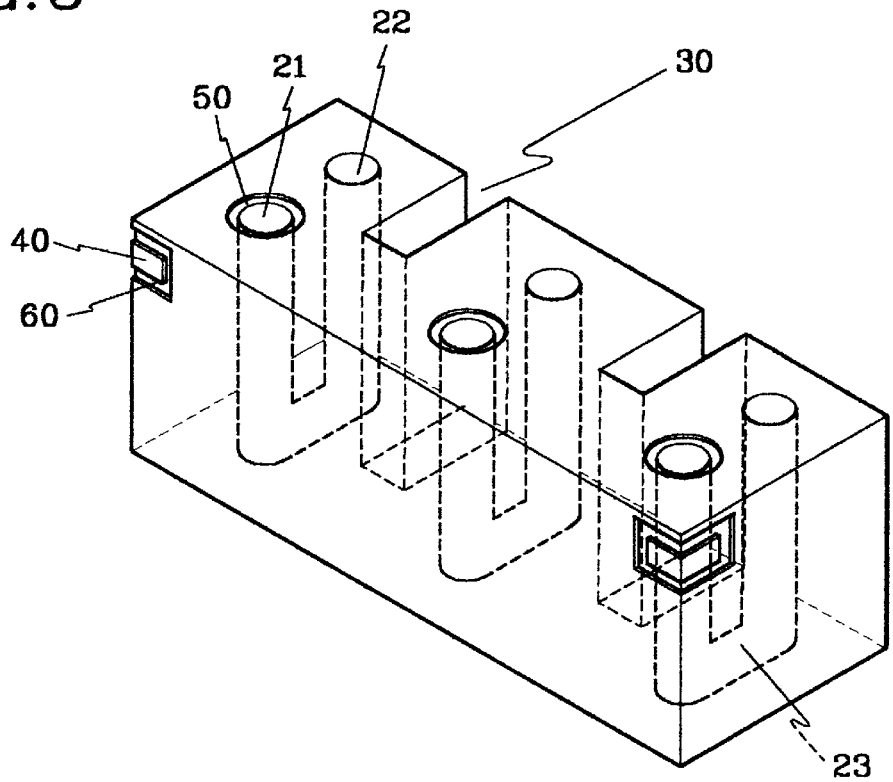
FIG. 3 is a filter construction view of other embodiment according to the present invention.

FIG. 3 is a filter construction view of other embodiment according to the present invention. The construction and operation of the resonator is equal to that of FIG. 1.

The excellent attenuation characteristics may be achieved at the stop band lower than the pass band, by forming the coupling control grooves 30 between the conductive tubes of the shorted end side of U-typed resonators, controlling the signals couple by means of the electric field between the resonators.

Figure 4:
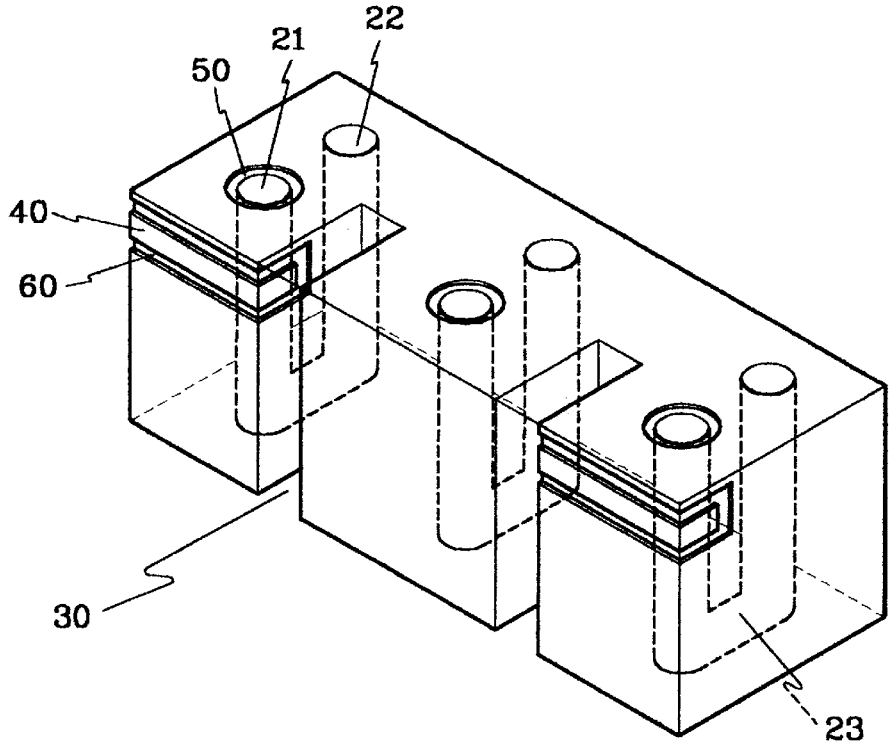
FIG. 4 is a filter construction view of another embodiment according to the present invention.

FIG. 4 is a filter construction view of another embodiment according to the present invention.

The construction and operation of the resonator is equal to that of FIG. 1. The input and output electrodes are electrically connected to three surfaces of the dielectric block by being insulated with the insulator to which three surfaces are connected from one portion of the side surface of the dielectric block to one portion of the side surface of the coupling control groove between the resonators, and the conductive film by means of the insulator, therefore, there is possible the surface package of a filter.

If the high frequency filter is fabricated using the is dielectric material according to the weight of the present invention, the filter of the present invention may be reduced by forming U-typed resonators instead of straight-typed resonators. The surface package is possible by respectively forming input and output electrodes on the outer wall of the dielectric block through two surfaces. There can be generated the pole point cutting off the signal transfer at frequency higher or lower than the pass band, using the difference of the characteristic impedance between the open end side resonator and the shorted direction the resonator. Accordingly, the filter according to the present invention, without external chip capacitor or inductor, may achieve excellent attenuation characteristics at the stop band of frequency higher or lower than the pass band. Furthermore, since the input and output terminals of the filter are formed on the dielectric block as the electrode through two or more surfaces, the coupling quantity between the input and output terminals and the resonators can be efficiently controlled, and the surface package is possible. Accordingly, it is unnecessary to provide an extra dielectric for forming the coupling quantity or the input and output conductive rod, and therefore, the filter of the present invention has an effect on simplification of the processes and cuts down manufacturing cost.

As described above, although the present invention has been described in detail with reference to illustrative embodiments, the invention is not limited thereto and various modifications and changes may be effected by one skilled in the art within the scope of the invention.

What is claimed is:

1. A microwave filter, comprising:

a dielectric block having a top surface and side surfaces coated with a conductive film;

a plurality of U-type conductive resonant tubes formed in said dielectric block in parallel, said U-type conductive resonant tubes being positioned at a predetermined distance from adjacent U-type conductive resonant tubes, each of said U-type conductive resonant tubes having a short end and an open end, the short end being on a side of a rear surface of said dielectric block and is electrically connected to the conductive film of the top surface of said dielectric block, and the open end being on a side of a front surface of said dielectric block and is insulated from the conductive film of the top surface of said dielectric block;

a coupling control groove, formed on a front surface of said dielectric block and between said U-type conductive resonant tubes, which prevents electric field signal coupling between the open ends of said U-type conductive resonant tubes;

a first input/output terminal formed on an edge of the front surface and a side surface of said dielectric block, said first input/output terminal being insulated from the conductive film of said dielectric block, and is electrically coupled with the dielectric block; and a second input/output terminal, formed on an edge of the front surface and another side surface of said dielectric block, said second input/output terminal being insulated from the conductive film of said dielectric block, and is electrically coupled with said dielectric block;

wherein each of said U-type conductive resonant tubes include:

two cylindrical penetrating holes which penetrate from between the top surface and a bottom surface of said dielectric block, an inner surface of the two cylindrical penetrating holes being coated with a conductive material, and a semicircular coupling groove, formed on the bottom surface of said dielectric block, which interconnects said two cylindrical penetrating holes, an inner surface of the semicircular coupling groove being coated with a conductive material.

2. The microwave filter according to claim 1, wherein said first input/output terminal is a stripe type terminal, the stripe type terminal being on said side surface of said dielectric block, said front surface of said dielectric block, and a side surface of said coupling control groove of said dielectric block furthest disposed on said side surface, and said second input/output terminal is a stripe type terminal, the stripe type terminal being on said another side surface of said dielectric block, said front surface of said dielectric block, and a side surface of said coupling control groove of said dielectric block furthest disposed on said another side surface.

3. The microwave filter according to claim 1, wherein said U-type conductive resonant tubes are formed in said dielectric block in parallel.

4. A microwave filter, comprising:

a dielectric block having a top surface and side surfaces coated with a conductive film;

a plurality of U-type conductive resonant tubes formed in said dielectric block in parallel, said U-type conductive resonant tubes being positioned at a predetermined distance from adjacent U-type conductive resonant tubes, each of said U-type conductive resonant tubes having a short end and an open end, the short end being on a side of a rear surface of said dielectric block and is electrically connected to the conductive film of the top surface of said dielectric block, and the open end being on a side of a front surface of said dielectric block and is insulated from the conductive film of the top surface of said dielectric block;

a coupling control groove, formed on a rear surface of said dielectric block and between said U-type conductive resonant tubes, which prevents electric field signal coupling between the short ends of said U-type conductive resonant tubes;

a first input/output terminal formed on an edge of the front surface and a side surface of said dielectric block, said first input/output terminal being insulated from the conductive film of said dielectric block, and is electrically coupled with the dielectric block; and a second input/output terminal, formed on an edge of the front surface and another side surface of said dielectric block, said second input/output terminal being insulated from the conductive film of said dielectric block, and is electrically coupled with said dielectric block;

wherein each of said U-type conductive resonant tubes include:

two cylindrical penetrating holes which penetrate from between the top surface and a bottom surface of said dielectric block, an inner surface of the two cylindrical penetrating holes being coated with a conductive material, and a semicircular coupling groove, formed on the bottom surface of said dielectric block, which interconnects said two cylindrical penetrating holes, an inner surface of the semicircular coupling groove being coated with a conductive material.

5. The microwave filter according to claim 4, wherein said U-type conductive resonant tubes are formed in said dielectric block in parallel.

* * * * *